US010406423B1

(12) United States Patent
Clarke

(10) Patent No.: US 10,406,423 B1
(45) Date of Patent: Sep. 10, 2019

(54) SCOREKEEPING DEVICE FOR BEANBAG GAME

(71) Applicant: Harry Clarke, Caret, VA (US)

(72) Inventor: Harry Clarke, Caret, VA (US)

( * ) Notice: Subject to any disclaimer, the term of this patent is extended or adjusted under 35 U.S.C. 154(b) by 0 days.

(21) Appl. No.: 16/112,724

(22) Filed: Aug. 26, 2018

(51) Int. Cl.

| | |
|---|---|
| ***A63B 67/06*** | (2006.01) |
| ***A63B 71/06*** | (2006.01) |
| *A63B 65/00* | (2006.01) |
| *A63B 63/00* | (2006.01) |

(52) U.S. Cl.
CPC ..... *A63B 71/0672* (2013.01); *A63B 67/06* (2013.01); *A63B 63/00* (2013.01); *A63B 65/00* (2013.01); *A63B 2071/0694* (2013.01); *A63B 2210/50* (2013.01); *A63B 2225/682* (2013.01)

(58) Field of Classification Search
CPC ..... A63B 71/0672; A63B 67/06; A63B 63/00
USPC ..... 273/398–402
See application file for complete search history.

(56) References Cited

U.S. PATENT DOCUMENTS

| | | | | | |
|---|---|---|---|---|---|
| 2,945,594 | A * | 7/1960 | Parker | B42F 13/02 | 211/46 |
| 3,220,127 | A * | 11/1965 | Wilson | A63B 71/0672 | 116/173 |
| 3,246,411 | A * | 4/1966 | Aafedt | A63B 71/0672 | 116/222 |
| 3,576,174 | A * | 4/1971 | Topel | A63B 71/0672 | 116/222 |
| 5,181,009 | A | 1/1993 | Perona | | |
| 5,329,874 | A * | 7/1994 | Posey | A63B 71/0672 | 116/222 |
| 5,615,636 | A * | 4/1997 | Gustafson | A63B 71/0672 | 116/223 |
| 5,681,108 | A | 10/1997 | Miller | | |
| 5,788,283 | A | 8/1998 | Adler | | |
| 6,012,995 | A | 1/2000 | Martin | | |
| 6,725,107 | B2 | 4/2004 | MacPherson | | |
| 7,607,666 | B1 * | 10/2009 | Studier | A63B 63/00 | 116/222 |
| 8,807,064 | B2 * | 8/2014 | Yang | A63F 11/0051 | 116/222 |
| 2002/0072815 | A1 | 6/2002 | McDonough | | |
| 2004/0108658 | A1 * | 6/2004 | Bartel | A63B 67/06 | 273/398 |
| 2008/0237990 | A1 * | 10/2008 | Litz | A63B 67/06 | 273/400 |
| 2011/0247545 | A1 * | 10/2011 | Degirmenci | A63B 71/0672 | 116/222 |
| 2013/0192515 | A1 * | 8/2013 | Holbrook | A63B 71/0672 | 116/223 |

* cited by examiner

*Primary Examiner* — Mark S Graham

(57) ABSTRACT

The invention is directed to a scorekeeping device for a beanbag game. The device provides a forked lower body and a cylindrical upper body. The fork points of the lower body may be inserted into mounting brackets on the bottom surface of the frame of a beanbag goal. The upper body provides scorekeeping discs which are movably mounted on two semicircular rings, and two cup holders which may be used to hold the users' drinks while the users throw beanbags at a goal. The lower body easily folds upward on the upper body for storage.

10 Claims, 1 Drawing Sheet

SCOREKEEPING DEVICE FOR BEANBAG GAME

This application relates back to, and claims the priority of Provisional Patent Application No. 62/578,464 filed on Oct. 29, 2017.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to outdoor games and accessories, and in particular to a scorekeeping device for a beanbag game. For many outdoor events, a game employing beanbags and plywood goals has become very popular. The game is usually played at events where beverages are served, and it is often challenging to simply put down a drink without spilling it to take one's turn tossing beanbags. The score of the game may also become confused.

A search of the prior art reveals various devices which have been developed to address this set of problems, or related problems. None are closely related to the present invention, but several include features which resemble those of the present invention. Each has proven to be less than satisfactory for the present purpose in its own way.

Electronic scorekeeping device and system therefor, U.S. Pat. No. 6,725,107 (priority Dec. 11, 2000), provides an electronic scorekeeping device which allows a user to electronically document data relating to events of a sports game. This data is transferred in real-time in a system according to the invention via a communications means to a central database. The central database may be coupled to a server computer which presents a web site whereby public users may access statistical information relating to a given sports game while the game is still in progress, as well as at and following the conclusion of the game. The web site may present archives of previously played games, and access thereto may be restricted by the use of a username and/or password. The data transfer to the database may be a live feed, or automatic transfers may be scheduled at predetermined time intervals. The device itself is customizable such that the data being gathered can be tailored to suit the specific sport being played. The user may further customize the menu-based screens displayed on the device in order to eliminate the prompting for any extraneous data that is not desired by the particular user.

Scorekeeping racket device with audio and visual display, U.S. Pat. No. 6,012,995 (priority Apr. 21, 1997), provides an automated scorekeeping device for racket and paddle sports. The device includes a voice recorder that is used to announce the score before each serve of the game. The device further includes optional visual displays. Actuating devices adapted to the equipment of the particular games are provided so that the players can easily operate the scorekeeper while participating in the game. The scorekeeper can be adjusted manually to correct mistakes, and can be used in multiple modes.

Golf scorekeeping system, U.S. Pat. No. 5,681,108 (priority Jun. 28, 1995), provides a small, lightweight, portable, handheld data processing system which stores and retrieves golf information and operates as a golf scorekeeper using a voice recognition system. The system includes a memory device, data input and output devices, a data transfer device, and a data processor. The golf scorekeeping system is capable of inputting, outputting, and storing data using a combination of manual, visual, and audio elements. The golf scorekeeping system utilizes a voice-to-digital converter, a computer, and a voice synthesis device to allow data to be input, output, and stored using voice recognition commands. The golf scorekeeping system is also capable of transmitting and receiving information to and from other devices such as printers or personal computers.

Timing and scorekeeping ring, U.S. Pat. No. 5,181,009 (priority Oct. 29, 1990), provides a timing and scorekeeping ring designed to be worn on the finger of an official's hand for displaying information related to sporting events and games. The indicator ring includes bands for mounting the indicator ring to the finger. An electronic display device includes a rectangular window (40) for displaying downs and an adjacent seconds window (42) for displaying seconds. Actuation of a push button switch controls the display of downs and a 25-second timer and a 60-timer displayed in the seconds window. Other timing and scorekeeping rings and are disclosed herein for use with basketball and baseball.

Portable information system and method for golf play enhancement, analysis, and scorekeeping, U.S. Patent Appl. No. 2002/0072815A1 (priority Jan. 21, 2000), provides a portable information system for golf. A hand-held computer (or, alternatively, a palm device) is used for providing a portable computer processing means to be carried by a golfer while playing a game of golf. A first software program (referred to as a Virtual Caddie™) is programmed in the hand-held computer for providing a virtual caddie to provide information regarding a particular golf course and a particular player's golf game, to track player performances, and to communicate a player's competitive match detail to other players. A macro stored on the hand-held computer (or palm device) is used for providing access to a virtual golf country club program residing on web servers for providing a golfer a means to evaluate his or her golf performance. A receiver means is selectively communicatively connected to the hand-held computer for enabling the hand-held computer to receive GPS and DGPS coordinate positions corresponding to a location on a golf course. A user interface is communicatively connected to the portable for enabling the golfer to interact with the hand-held computer.

Score keeping game system, U.S. Pat. No. 5,788,283 (priority Jul. 11, 1996), provides a score keeping game system for tracking the performance of at least one athlete. Score keeping game system includes at least one score tracking device, the score tracking device including a card member and jacket. Card member includes a recording section formed on one side thereof and having subdivision indicia markings formed thereon for indicating and subdividing the recording section. Jacket is formed by a pair of wall members formed of a plastic material and joined together with an opening on one edge thereof for passage of the card member between the pair of wall members. At least one of the wall members has an opening formed therethrough to provide access to the recording section of the card member.

If a device could be used which would resolve both of these problems, it would be very useful and would be well received. A scorekeeping device for a beanbag game, which may be mounted on the frame of the goal and may be used to keep score and hold drinks, would resolve these problems.

SUMMARY OF THE INVENTION

Accordingly, the invention is directed to a scorekeeping device for a beanbag game. The device provides a forked lower body and a cylindrical upper body. The fork points of the lower body may be inserted into mounting brackets on the bottom surface of the frame of a beanbag goal. The upper body provides scorekeeping discs which are movably mounted on two semicircular rings, and two cup holders which may be used to hold the users' drinks while the users throw beanbags at a goal. The lower body easily folds upward on the upper body for storage.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
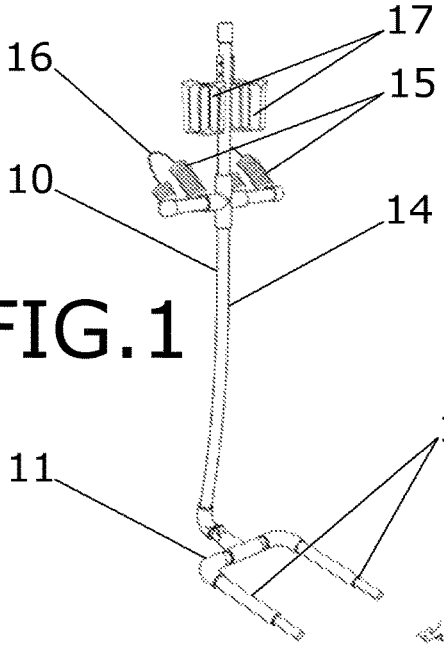
FIG. 1 is a side perspective view of the first exemplary embodiment, displaying the device 10, the lower body 11, the fork points 12, the mounting brackets 13, the upper body 14, the scorekeeping discs 15, the rings 16, and the cup holders 17.
Figure 2:
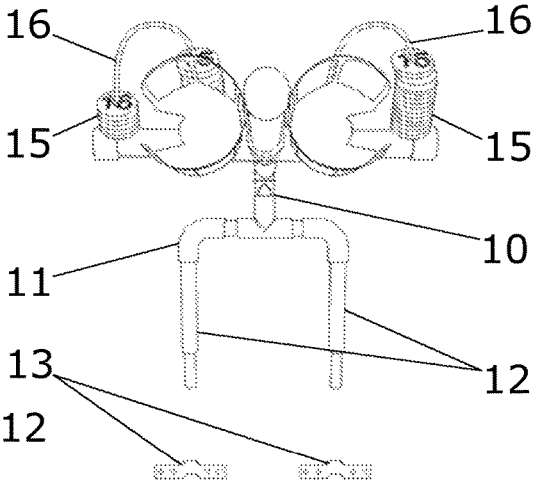
FIG. 2 is a top view of the first exemplary embodiment, displaying the device 10, the lower body 11, the fork points 12, the mounting brackets 13, the scorekeeping discs 15, the rings 16, and the cup holders 17.
Figure 3:
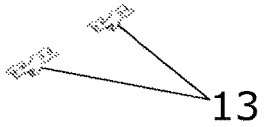
FIG. 3 is a side perspective view of the first exemplary embodiment, displaying the device 10, the lower body 11, the hinge 11A, the mounting brackets 13, and the upper body 14.
Figure 4:
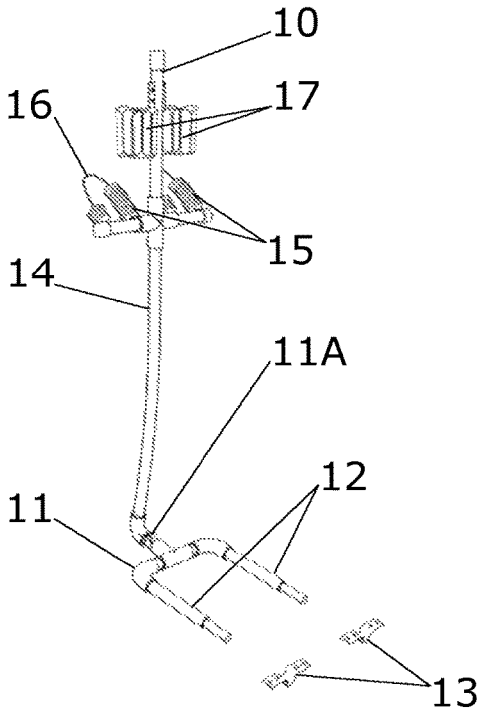
FIG. 4 is a front perspective view of the first exemplary embodiment in the folded position, displaying the device 10, the lower body 11, the hinge 11A, and the upper body 14.
Figure 4:
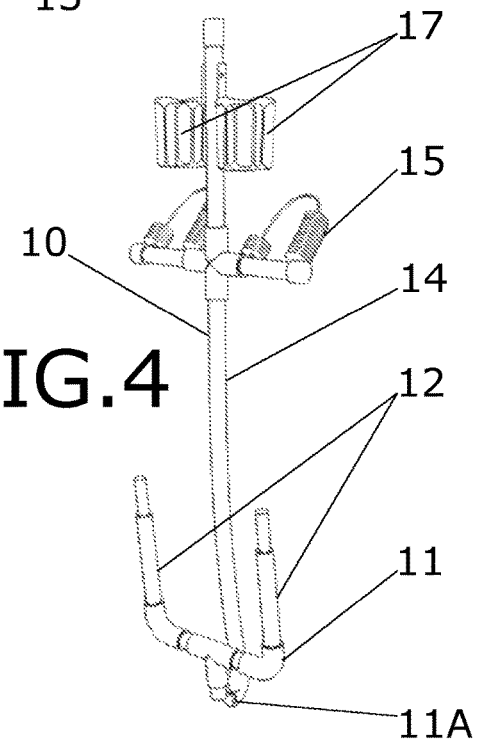

Referring now to the invention in more detail, the invention is a scorekeeping device 10 for a beanbag game. The device provides a forked lower body and a cylindrical upper body. The fork points of the lower body may be inserted into mounting brackets on the bottom surface of the frame of a beanbag goal. The upper body provides scorekeeping discs which are movably mounted on two semicircular rings, and two cup holders which may be used to hold the users' drinks while the users throw beanbags at a goal. The lower body easily folds upward on the upper body for storage.

The first exemplary embodiment is comprised of a device 10 which provides a forked lower body 11 and a cylindrical upper body 14, joined by a hinge 11A. The lower body 11 terminates in two fork points 12 which are perpendicular to the upper body 14 when unfolded. Devices 10 are preferably provided in pairs, corresponding to the two goals of a beanbag game.

The fork points 12 of the lower body 11 may be inserted into mounting brackets 13, which in turn may be affixed to the bottom surface of the frame of a beanbag goal with screws, nails, or similar fasteners. The upper body 14 provides scorekeeping discs 15 which are movably mounted on two semicircular rings, 16 and two cup holders 17 which may be used to hold the users' drinks while the users throw beanbags at a goal. Using the hinge 11A, the lower body 11 easily folds upward on the upper body 14 for storage. The scorekeeping discs 15 are clearly marked with large numbers, such that the user may easily keep score of a game played in dim lighting conditions.

To use the first exemplary embodiment, the user may unfold each device 10 and insert the fork points 12 into the mounting brackets 13, which were previously installed on a goal. The user may then keep score by flipping over a scorekeeping disc 15 when a goal is scored. The user may also secure his drink on one of the cup holders 17 when throwing the beanbags.

The lower body 11, the upper body 14, the scorekeeping discs 15, and the cup holders 17 are preferably manufactured from rigid, durable materials, such as aluminum alloy, plastic, hardwood, fiberglass, and steel. The mounting brackets 13 and the rings 16 are preferably manufactured from rigid, durable materials which provide substantial structural strength, such as aluminum alloy, brass, and steel. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A scorekeeping device for a beanbag game, comprising: a forked lower body and a cylindrical upper body, joined by a hinge, such that fork points of the lower body are configured to be inserted into mounting brackets on a bottom surface of a frame of a beanbag goal, and the upper body comprises scorekeeping discs which are movably mounted on two semicircular rings, and including two cup holders which are configured to hold users' drinks.

2. The scorekeeping device of claim 1, wherein the lower body folds upward on the upper body for storage.

3. The scorekeeping device of claim 1, wherein the lower body terminates in two fork points which are perpendicular to the upper body when unfolded.

4. The scorekeeping device of claim 1, wherein the scorekeeping device is provided in pairs, corresponding to two goals of the beanbag game.

5. The scorekeeping device of claim 1, wherein the fork points of the lower body are configured to be inserted into mounting brackets, which in turn are configured to be affixed to the bottom surface of the frame of a beanbag goal with screws, nails, or similar fasteners.

6. The scorekeeping device of claim 1, wherein using the hinge, the lower body folds upward on the upper body for storage.

7. The scorekeeping device of claim 1, wherein the scorekeeping discs are marked with numbers, such that the user may keep score of a game played in dim lighting conditions.

8. The scorekeeping device of claim 1, wherein the scorekeeping device is adapted to be unfolded and the fork points are insertable into the mounting brackets, which were previously installed on a goal, which enables score to be kept by enabling a scorekeeping disc to be flipped when a goal is scored.

9. The scorekeeping device of claim 1, wherein the lower body, the upper body, the scorekeeping discs, and the cup holders are manufactured from rigid, durable materials, including any one or more of aluminum alloy, plastic, hardwood, fiberglass, and steel.

10. The scorekeeping device of claim 1, wherein the mounting brackets and the rings are manufactured from rigid, durable materials which provide substantial structural strength, including any one or more of aluminum alloy, brass, and steel.

* * * * *